US007637217B2

(12) United States Patent
Barry

(10) Patent No.: US 7,637,217 B2
(45) Date of Patent: Dec. 29, 2009

(54) RAILWAY AUTO CARRIER AND LOADING SYSTEM

(76) Inventor: Leonard D. Barry, 19300 Pennington Dr., Detroit, MI (US) 48221

( * ) Notice: Subject to any disclaimer, the term of this patent is extended or adjusted under 35 U.S.C. 154(b) by 267 days.

(21) Appl. No.: 11/745,087

(22) Filed: May 7, 2007

(65) Prior Publication Data

US 2008/0276829 A1 Nov. 13, 2008

Related U.S. Application Data

(63) Continuation-in-part of application No. 11/536,298, filed on Sep. 28, 2006, and a continuation-in-part of application No. 11/733,789, filed on Apr. 11, 2007, which is a continuation-in-part of application No. 11/536,298, filed on Sep. 28, 2006.

(60) Provisional application No. 60/721,300, filed on Sep. 28, 2005.

(51) Int. Cl.
*B61D 3/00* (2006.01)

(52) U.S. Cl. ..... 105/355; 105/413; 105/404

(58) Field of Classification Search ..... 105/355, 105/404, 370, 413, 407, 411; 414/334, 339, 414/349, 350, 352; 410/28, 28.1, 3, 4, 5, 410/6, 13, 14, 15, 24, 26, 27, 29, 29.1; 104/18, 104/29

See application file for complete search history.

(56) References Cited

U.S. PATENT DOCUMENTS

| | | | | |
|---|---|---|---|---|
| 1,139,411 A | | 5/1915 | Gunn | |
| 2,959,262 A | * | 11/1960 | Parker et al. | 410/27 |
| 3,230,900 A | * | 1/1966 | Ruprecht et al. | 410/26 |
| 3,892,188 A | * | 7/1975 | Warren | 410/28 |
| 4,130,208 A | | 12/1978 | Barry | |

* cited by examiner

*Primary Examiner*—Mark T Le
(74) *Attorney, Agent, or Firm*—Gifford, Krass, Sprinkle, Anderson & Citkowski, P.C.

(57) ABSTRACT

This invention is a railway car and system to carry automobiles and load and unload them by drivers driving under a bridge-like opening to ramps through the car and centering the auto parallel to and under the car. A ramp or lift takes the auto up to floor level. The auto is driven, pulled or pushed to storage spaces on the train including up ramps which are hinged at the top and let down to tale vehicles between one or more upper levels or to tilt park the vehicle on the ramp. These ramps are pulled up with a vehicle chocked thereto to get the maximum practical number of vehicles on the railway car. The rail car can be loaded while stationary or while moving along an area paved flush with the rails.

6 Claims, 2 Drawing Sheets

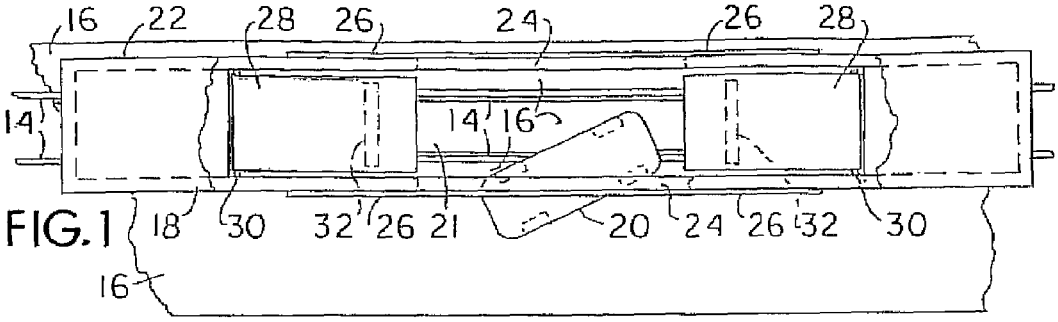
FIG. 1
FIG. 2
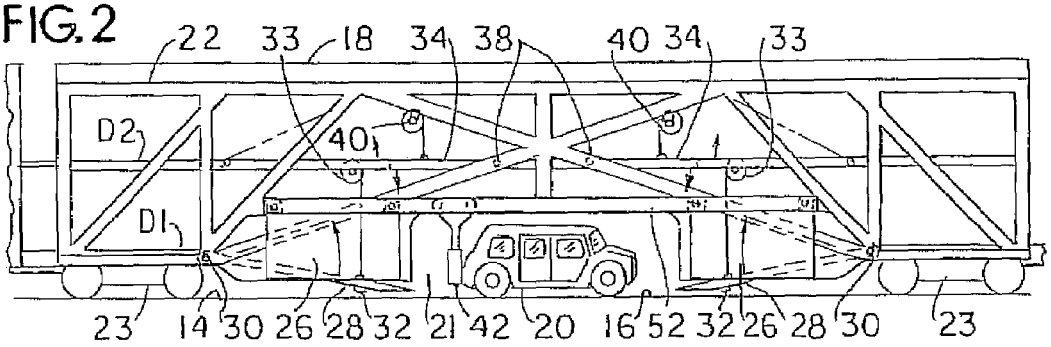
FIG. 3
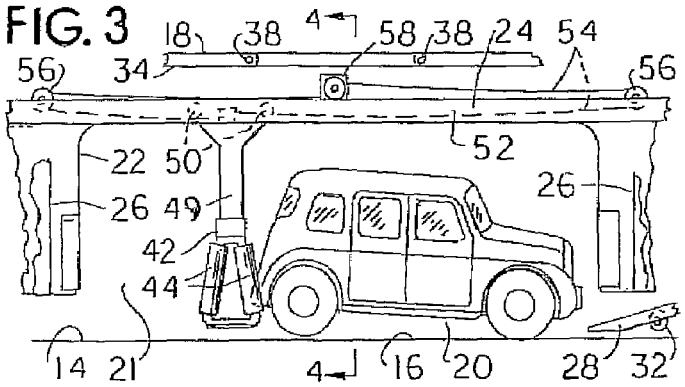
FIG. 4
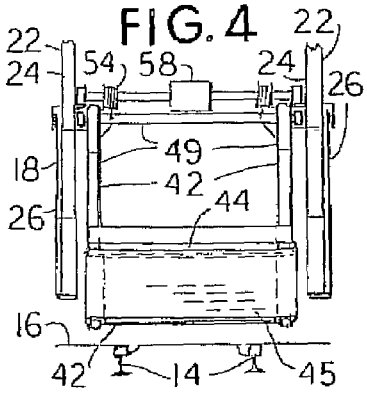

RAILWAY AUTO CARRIER AND LOADING SYSTEM

FIELD OF THE INVENTION

This is an auto-carrier railway car and loading system with an onboard loading berth opening and ramps for drive-in loading and unloading of autos etc. onto the railway car or several cars. While there is side loading of railway cars by driving on trucks and autos from a dock, as for the Chunnel between England and France, my new invention provides a railway car which can be loaded and unloaded from ground level without docks or ramps at the loading area. The car's frame is open center with side sills and a bottom loading opening through the car to drive autos in the space between and under the side sills of the frame and up a ramp on the car to storage levels.

SUMMARY OF THE INVENTION

The main object is to provide an auto-rack railway car that can be loaded while in a passenger train from underneath at track level while either moving or stationary.

It is an object to provide a low-cost or zero-cost loading area, i.e., no elevated dock needed, so it can even be at a road-rail crossing.

It is an object to be able to load and unload existing autos etc. on these moving or standing railway cars with no modifications needed to the highway vehicles.

It is an object to have a walkway on each side of the cars so the drivers and passengers can get to and from them to ride in other cars in the train.

It is an object to provide drop ramps to the second or higher levels to put vehicles up out of a first level driveway on the car and to selectively lower or raise autos to drive them on and off of the train.

It is an object to provide a design for this car that has a strong frame relative to its weight, one symmetrical in cross section.

It is an object to provide room under the rail car to steer an auto, with regular steering, to align with the center of the car and provide devices to soft push the car from either end.

It is an object to provide this full sized and miniature as a toy.

It is an object to provide a system for train passengers to drive their autos on and off trains moving nonstop at intermediate stations.

It is an object to provide an auto carrier rail car with its frame bridged over an opening for driving a road vehicle on a driveway at track level into the opening and up a ramp to load and unload the auto carrier rail car anywhere in a train.

It is an object to provide a line of joined together auto rack railroad cars with a loading car of this new design at each end each with a loading berth with a loading ramp facing up from opposite ends of the line of cars.

It is an object to provide a loading ramp at each end of the opening hinged to lift to become a storage space on the car.

It is an object to provide a sturdy frame design with area of high ground clearance for a railway car for ground level bottom loading.

It is an object to provide a push-lift paddle to travel the transfer opening under the railway car for pushing vehicles onto the ramp on the railway car.

It is an object to lift the auto's drive wheels up when transferring between the driveway and ramp at train speed.

It is an object to provide means to drive autos onto and off from trains in motion without stopping the autos between the driveway and a parking spot on the train.

BRIEF DESCRIPTION OF THE DRAWINGS

These, other and further objects should become evident to those skilled in the art by studying this specification taken with reference to the drawings wherein:

FIGS. 1 and 2 are respectively plan and side elevation of the preferred transfer car in a train along a loading drive.

FIG. 3 is a side view of the central portion of the railroad car engaging an auto for transfer to the train to larger scale.

FIG. 4 is a section on line 4-4 of FIG. 3.

DETAILED DESCRIPTION OF THE INVENTION

Figure 5:
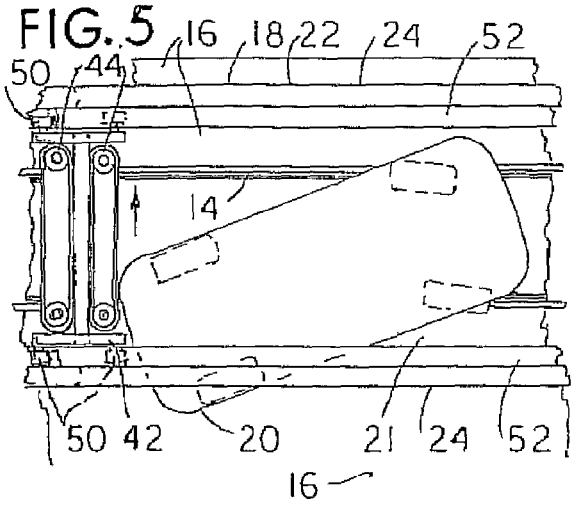
FIGS. 5 and 6 are respectively plan views of an auto moving into and out from a train moving to the right.
Figure 6:
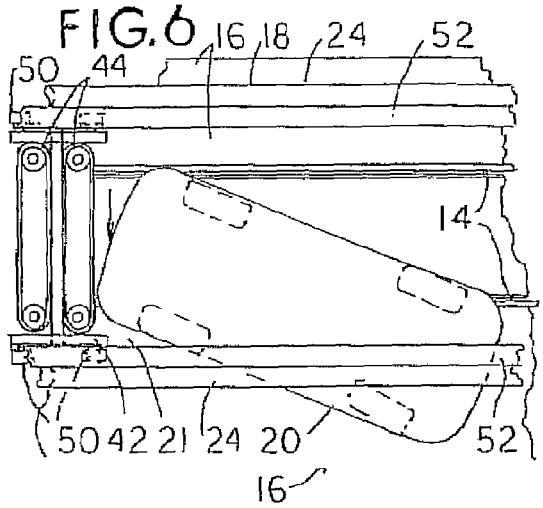

Referring to the drawings and in particular to FIGS. 1-6 track 14 imbedded flush in driveway 16 has auto carrier railroad car 18 stopped on track 14 for loading and unloading vehicles such as light trucks and automobiles 20 of shippers or travelers that they drive into and opening 21 in the sides and bottom of the car 18.

Car 18 has a frame 22 which is supported on and extends between its trucks 23 as a bridge frame with side sills 24 rising from the ends above trucks 23 up to clear along over the loading-unloading opening berth 21 for autos to drive under this mid-section of the frame and align parallel to car 18. This opening 21 can be covered by rolling side doors 26 opened and closed by cable drive 27. Car 18 has a drive-on loading ramp 28 at each end of berth 21 to a first and second deck D1 and D2 respectively.

Ramp 28 is pivotally secured on pins 30 at each end farthest from berth 21 in frame 22. Ramps 28 tilt down to near track level at berth 21 so a vehicle 20 can be driven from berth 21 up or down the ramp from either end of the berth. If the car 18 is moving it would be the forward end. Ramp 28 has rollers 32 secured near its lower end to engage and roll on track 14 along driveway 16 Ramp 28 is lifted and lowered by cable winch 33 to down position, level D1, and raised position to level D2.

A storage berth over berth 21 has a half ramp 34 at each end pivoted on pins 38 to sills 24 near center of their berth to let down to align and connect with the drive on-off ramps 28 to complete the rampway to the second level from either end of car 18. Ramps 34 are lifted by rope and winches 40 and supported by frame 22.

This is sufficient to load and unload autos 20 all but in area 21 when car 18 is stationary. But if car 18 is moving it is easier and safer to load and unload with an added push paddle 42.

Referring to FIGS. 3-6 push paddle 42 has two endless belt-over-roller conveyors 44 to engage autos at bumper height. Conveyors 44 each have a longitudinally grooved belt 45 on grooved rollers standing on end in frames forked apart at a shallow angle on a depending bracket frame 49 suspended on rollers 50 on track 52 run horizontally along the insides of car 18 over berth 21 and driven to either end of berth 21 by endless cable or roller chain 54 around drum or sprockets 56 driven by a reversible gear motor 58 and variable electric clutch which provides a cushion and limited force for the paddle. Paddle 42 travels the length of the loading berth and pushes in either direction. Paddle conveyors 44 extend across berth width to back, hold, or push vehicle 20 during loading and unloading. The paddle can push a stalled vehicle 20 up onto either ramp 28 and the ramp lift the vehicle to level D1. The paddle is supported on four rollers or wheels 50 on channel track 52 secured to side sills 24 to reduce or eliminate swing. The angle of conveyors 44 lift the drive end of auto 20 so its drive wheels have more time to adjust speed when entering or leaving driveway 16 from and to a ramp 28. The auto 20 upon entering a moving berth 21 can roll slower than the train and bump the paddle which helps center vehicle 20 by letting the vehicle shift sideways on the paddle 42 and prevents damage to the vehicle 20 being pushed by the train.

Ramps 28 at each end of berth 21 can be lowered and lifted with load to use for loading the train and then lifted with a vehicle stored on the ramp. Ramps 28 have flangeless wide rollers 32 secured below to ride track 14 so the train can be loaded while moving and only touching track 14 when pushed down by heavy loads entering and leaving the ramps. Ramps have wheel chocks (not shown) to secure a vehicle to the ramp for transport.

Operation

Figure 7:
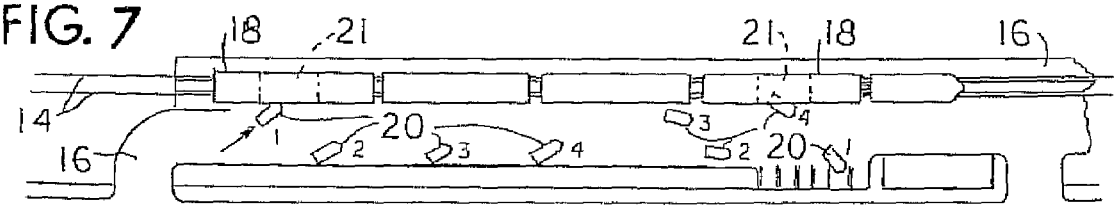
FIG. 7 is a plan schematic of a station runway with autos entering and leaving the train moving to the right.

A block of auto rack cars with a car 18 at each end, FIG. 7, can be loaded and unloaded with vehicles 20 while in a train standing or moving on track 14 along runway 16. Using preferably the rear car 13 to enter, drive up forward ramp 28 and over bridges between oars and up ramps to other levels that are preferably bridged between cars to parking places forward and back. To unload go out rear ramps of either end car 18 or backward out of the forward ramp 28 of either end car 18.

To load the rear car 18 each vehicle 20 is driven forward in succession from a line alongside of the train and in under berth 21 like parallel parking the autos one at a time in the same space 21 but without stopping but simpler if the train is moving because the drivers never need to stop or back up to put their vehicles on board. The drivers drive up the forward ramps 28 one behind the other to load the car or train nonstop to their parking spots. When the car is full except for ramps 28, and a few back-up moves to fill the rear few spots on the rear car 18, vehicles 20 are driven forward and backed onto ramps 28 fore and aft of berth 21 respectively, leaving the space at berths 21 in the two cars in the train.

If the incoming auto 20 when aligned in booth 21 exceeds train speed it starts up the forward ramp 28 without the assistance of paddle 42. Its spinning wheels would suddenly be slowed by hitting the forward ramp. This should be avoided at all but low speed by using paddle 42 to lift the vehicle.

Having thus described my invention with a few variations, this is not intended as a limitation on the scope of my invention which is intended to be covered by the claims to be submitted for this invention to include variations, applications, and parts which would be apparent to those skilled in the art and which are within the spirit and scope of this invention.

I claim as my invention:

1. A track-level-bottom-loading railway car especially for carrying automotive vehicles, said railway car including a frame having side sills and trucks supporting said frame, said side sills arising at the sides of the car up from over the trucks to span over an opening open to the ground under said frame between said trucks for driving an auto at track level under said frame for loading on and off of the railway car, a drive-on ramp under and parallel to said frame and extending up from said opening and secured to said frame, at least one vehicle storage way connected to said ramp to hold vehicles for transport on the car whereby said car can be loaded and unloaded of autos while moving in a train or standing.

2. A railway car as in claim 1, said ramp being pivotally mounted transversely to said frame and a hoist connected between said frame and ramp for lifting and lowering said ramp to lower to near track level.

3. A railway car as in claim 2, said ramp having at least one wide roller mounted below the ramp to roll on the railroad track along a loading driveway when lowered and weight of a vehicle is added.

4. A railway car as in claim 1 and a push paddle comprising two depending brackets, a track secured along the infacing side of each of said side sills of said frame over said opening supporting said brackets to move along said track, a vehicle cushioning member connected between the lower ends of said brackets, and drive means connected between said frame and said brackets for moving said brackets back and forth along said track to push a vehicle that is under said opening up onto said ramp.

5. A railway car as in claim 4, said cushioning member having a substantially vertical roller depending to rotate on each said bracket and aligned in parallel, an endless belt connected over and between each said roller to cushion against a vehicle in said opening, said belt being thus mounted to shift transversely to said frame to help move a vehicle transversely into and out from said opening.

6. A railway car as in claim 5, each said roller and said belt being grooved to interfit to support said belt from sliding down on each said roller.

* * * * *